US010470621B1

(12) United States Patent
Moore

(10) Patent No.: US 10,470,621 B1
(45) Date of Patent: Nov. 12, 2019

(54) UNIVERSAL COVER FOR HYGIENE CLOTH DISPENSERS

(71) Applicant: Julie Moore, Brentwood, TN (US)

(72) Inventor: Julie Moore, Brentwood, TN (US)

( * ) Notice: Subject to any disclaimer, the term of this patent is extended or adjusted under 35 U.S.C. 154(b) by 0 days.

(21) Appl. No.: 16/240,375

(22) Filed: Jan. 4, 2019

(51) Int. Cl.
*A47K 10/32* (2006.01)
*B65D 83/08* (2006.01)
*B65D 1/32* (2006.01)

(52) U.S. Cl.
CPC ..... *A47K 10/32* (2013.01); *B65D 1/32* (2013.01); *B65D 83/0805* (2013.01); *A47K 2010/3233* (2013.01); *A47K 2010/3266* (2013.01)

(58) Field of Classification Search
USPC ..... 221/33–63
See application file for complete search history.

(56) References Cited

U.S. PATENT DOCUMENTS 6,592,004 B2 7/2003 Huang et al.
6,834,773 B2 12/2004 Wu
7,416,083 B2 8/2008 Bando
7,621,401 B2 11/2009 Alegre De Miquel
8,113,381 B2 2/2012 Che
8,312,991 B2 11/2012 Diebel et al.
8,783,768 B2 7/2014 Severinski et al.
9,056,696 B1 6/2015 Reyes
2007/0181592 A1* 8/2007 Prevo ..... A47K 10/3818 221/48
2009/0127276 A1* 5/2009 Rippl ..... A47K 10/424 221/45
2010/0001015 A1 1/2010 Thoren et al.
2012/0117776 A1 5/2012 Bourns et al.
2013/0165190 A1 6/2013 Ko et al.
2014/0374432 A1* 12/2014 Bechyne ..... A45C 13/1023 221/45
2015/0210468 A1* 7/2015 Stephens ..... A47K 10/42 206/229
2015/0216378 A1 8/2015 Fulscher et al.
2015/0238002 A1 8/2015 Kinskey
2016/0088980 A1* 3/2016 BenMark Markovitch ..... A45F 5/022 221/45
2016/0106273 A1* 4/2016 Yamada ..... B65D 75/5877 221/1

* cited by examiner

*Primary Examiner* — Jacob S. Scott
*Assistant Examiner* — Ayodeji T Ojofeitimi
(74) *Attorney, Agent, or Firm* — Resolute Legal PLLC

(57) ABSTRACT

A universal cover for hygiene cloth dispensers includes a flexible pouch for holding hygiene cloths stored in a plurality of different hygiene cloth dispensers. The flexible pouch has a top wall, a bottom wall, and an interior space between the top and bottom walls. The universal cover includes a seam that can be opened to an open position and resealed to a closed position to connect the top wall to the bottom wall. The open position defines a refill opening for receiving the different hygiene cloth dispensers. A dispensing opening is formed in the top wall of the universal cover. The dispensing opening is reinforced against deformation due to exposure to moisture, body oils, dirt, and stretching. The dispensing opening is sized such that different sized movable and non-movable covers of at least two different commercial hygiene cloth dispensers are accessible through the dispensing opening.

15 Claims, 7 Drawing Sheets

UNIVERSAL COVER FOR HYGIENE CLOTH DISPENSERS

FIELD OF THE INVENTION

The present disclosure relates to covers for wipes dispensers.

BACKGROUND

Wipes are often prepackaged in poorly made wipes dispensers. Improvements to the wipes dispensers are needed to better protect the wipes.

SUMMARY

In one embodiment, a universal cover for hygiene cloth dispensers defines a length dimension and a transverse width dimension. The universal cover includes a flexible pouch. The pouch has a top wall and a bottom wall. The top wall has a top wall periphery, and the bottom wall has a bottom wall periphery. The top and bottom walls are connected to each other along their respective peripheries to define a flexible interior space sandwiched or otherwise positioned therebetween.

The universal cover includes one or more seams that can be opened to an open position and resealed to a closed position to connect the top wall to the bottom wall. The open position defines a refill opening for receiving various different commercial hygiene cloth dispensers. A dispensing opening is formed in the top wall of the reusable cover. The dispensing opening is reinforced against deformation due to exposure to moisture, body oils, dirt, and stretching. The dispensing opening is sized such that hygiene cloths are fully accessible through the dispensing opening from different sized movable and non-movable covers of at least two different commercial hygiene cloth dispensers.

DETAILED DESCRIPTION

In various embodiments, a universal cover 10 is described, which can house a variety of different commercial wipes dispensers, refillable wipes dispensers, or other suitable wipes dispensers. The various different commercial wipes dispensers may dispense items such as dry tissues, gauze, pre-moistened or wet wipes, such as diapering wipes, toileting wipes, feminine care wipes, absorbent paper, disposable or reusable cloths, or other hygiene cloths known in the art. While the term commercial wipes dispensers is used throughout this specification, it should be appreciated that commercial wipes dispensers comprise refillable wipes dispensers and other suitable hygiene cloth dispensers.

Figure 1:
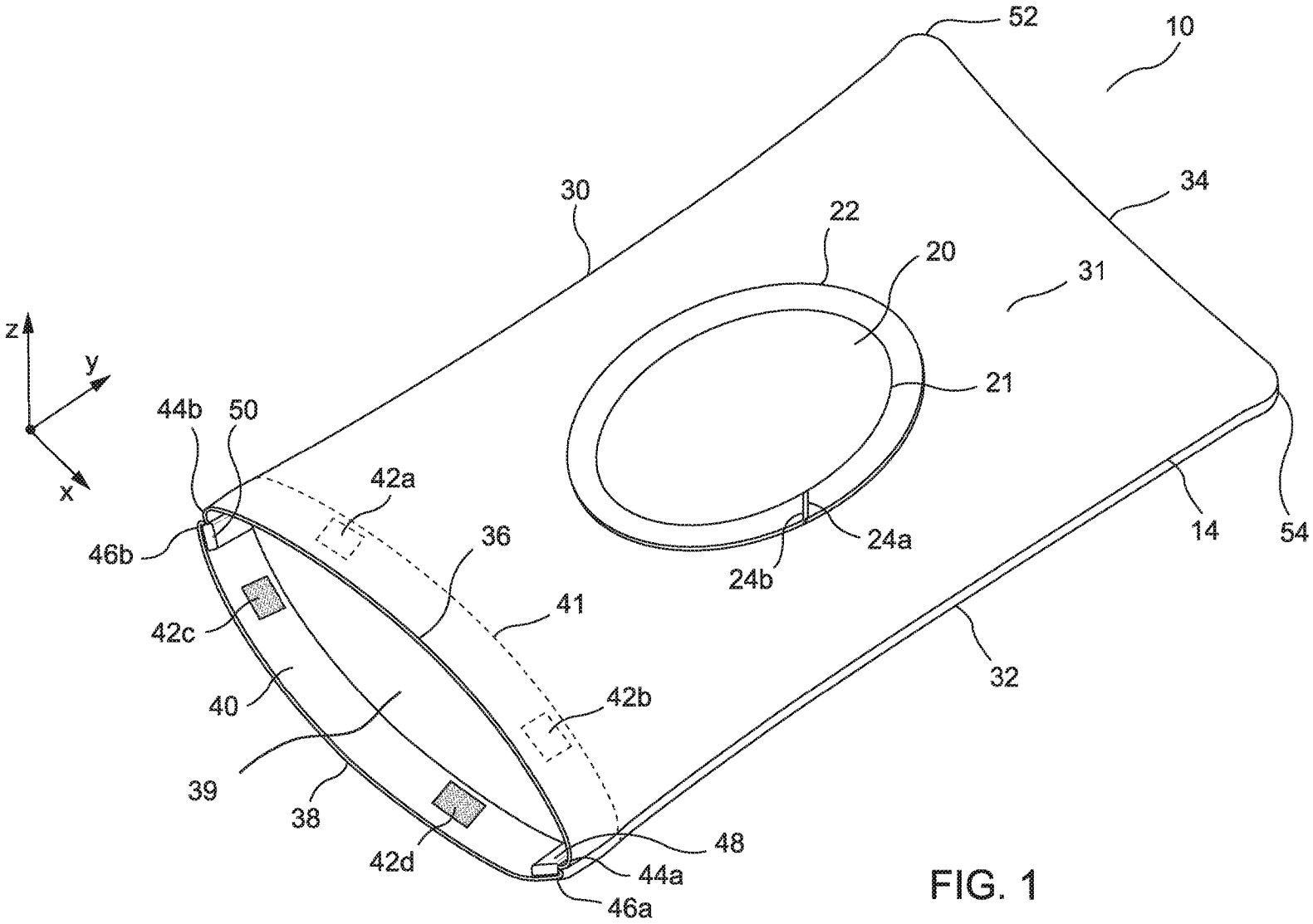
FIG. 1 is a front perspective view of one embodiment of a universal cover.
Figure 2:
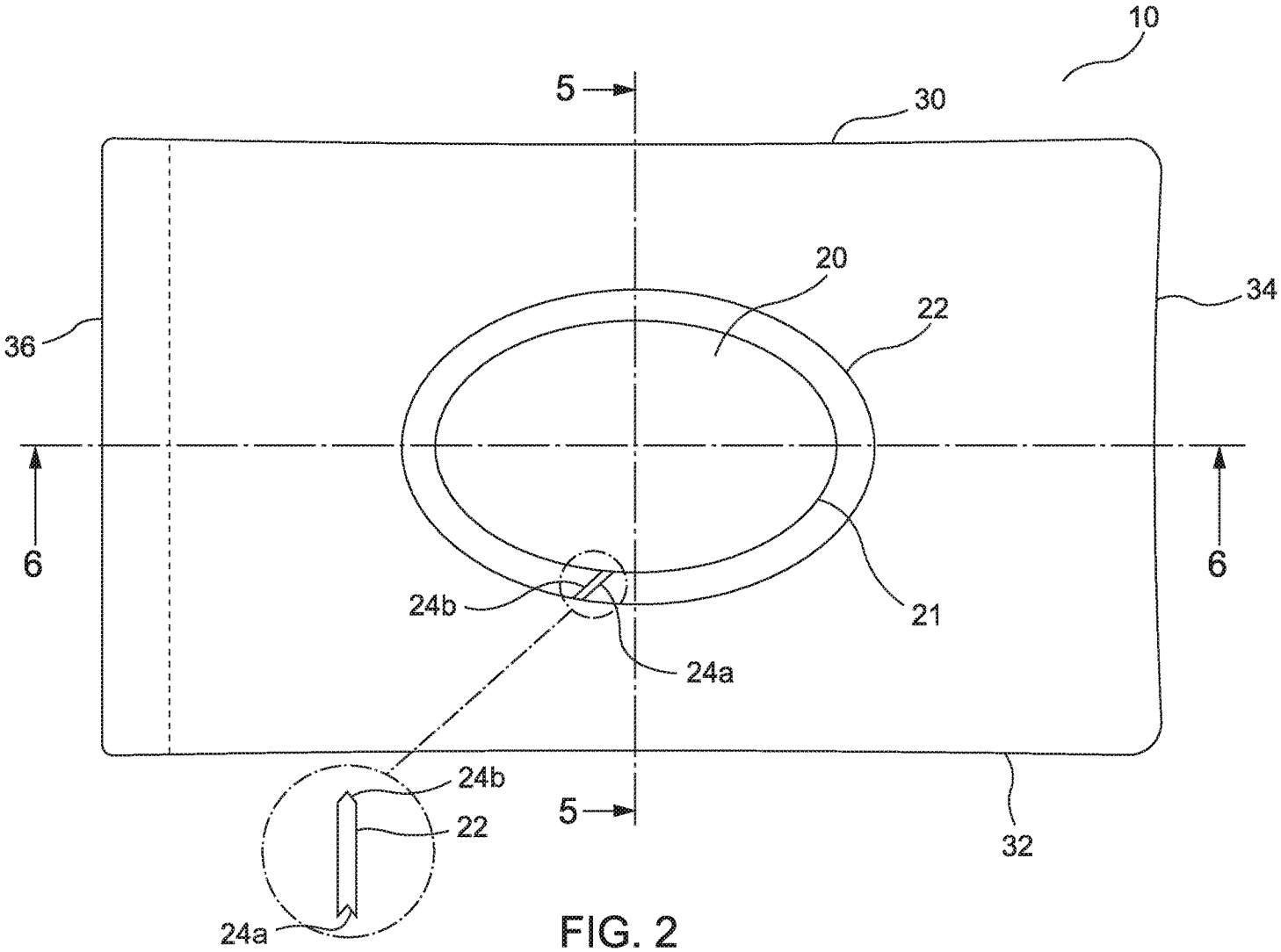
FIG. 2 is a top view of one embodiment of a universal cover.

FIG. 1 illustrates a front perspective view of one embodiment of an universal cover with an open seam for various different commercial wipes dispensers. The universal cover 10 defines a length dimension x and a transverse width dimension y as illustrated in FIG. 2. The universal cover 10 comprises a flexible pouch 14 that is formed from a top wall 31 and a bottom wall 38. The top wall 31 includes a periphery formed along edge 30 and edge 32, which run along the length dimension x. In one embodiment, edge 30 and edge 32 are approximately 11 inches. However, other suitable lengths may be used as needed to accommodate new commercial wipes dispensers. The top wall 31 periphery also includes edge 34 and edge 36, which run along the transverse width dimension y. In one embodiment, edge 34 and edge 36 are approximately 7 inches. However, other suitable lengths may be used as needed to accommodate new commercial wipes dispensers. The bottom wall 38 includes a periphery formed along edge 30 and edge 32, which run along the length dimension x. The bottom wall 38 periphery also includes edge 34 and edge 36, which run along the transverse width dimension y. Top wall 31 and bottom wall 38 may flexible move in the z dimension relative to each other to accept commercial wipes dispensers.

Top wall 31 includes an opening 20. Opening 20 may be positioned in the center of top wall 31. However, opening 20 may be positioned in any suitable position to accommodate a different variety of commercial wipes dispenser openings. Opening 20 may be formed as an ellipse, having a major diameter of approximately 4 and ⅜ inches and a minor diameter of approximately 2 and 11/16 inches. It should be appreciated that other dimensions may used as needed to accommodate new commercial wipes dispensers. Such an elliptical shape with these approximate diameters for opening 20 permits universal cover 10 to accept and make a large variety of commercial wipes dispensers openings accessible. Commercial wipes dispensers come in a variety of different forms. Some commercial wipes dispensers include movable or removable caps. Some commercial wipes dispensers do not have caps. Some include wipe dispenser openings that are different shapes, such as ovals, squares, rectangles, etc. That is, if opening 20 is smaller or formed in a different shape, opening 20 may not enable easy access to a large variety of commercial wipes dispensers. For example, if opening 20 was smaller or formed in a different shape, when certain commercial wipes dispenser that included a movable or removable cover were inserted into universal cover 10, opening 20 may inhibit or prohibit a person from opening or easily accessing wipes from certain commercial wipes dispensers. However, in some embodiments, the opening 20 may be formed in any suitable different shape (e.g., a square or rectangle) and may include different radii or areas to accommodate fewer or more commercial wipes dispensers.

In one embodiment, the periphery of opening 20 in top wall 31 is covered with a reinforcing band 22. The reinforcing band 22 provides added strength to a lip 21 around opening 20. Over time, as universal cover 10 is used, moisture from pre-moistened wipes, body oils, dirt, and deformation stresses on lip 21 may cause lip 21 in top wall 31 to permanently stretch or deform, or even disintegrate. Such stretching, deformation, or disintegration may cause the universal cover 10 to be unfit for purpose and reduce the useful life of universal cover 10. By adding a reinforcing band 22 around lip 21, the material of top wall 31 is strengthened and may prevent or drastically retard such stretching, deformation, or disintegration.

The reinforcing band 22 may be a rectilinear strip. The reinforcing band 22 may extend approximately ½ an inch from lip 21 around opening 20 in top wall 31. It should be appreciated that other dimensions may be used as needed to accommodate new commercial wipes dispensers. In one embodiment, the lip around the opening 20 in top wall 31 is sandwiched or otherwise positioned between reinforcing band 22. That is, reinforcing band 22 wraps around the top and underside of the lip 21 of opening 20 in top wall 31. Reinforcing band 22 may be attached to the lip 21 around the opening 20 with a moisture resistant adhesive. In some embodiments, reinforcing band 22 is stitched or sewn to the lip 21 around the opening 20. In alternative embodiments, reinforcing band 22 is attached to the lip 21 around opening 20 with adhesive and with stitching. In some embodiments, reinforcing band 22 is formed with a triangular end 24*a* on one end and a matching notched end 24*b* on the other end as illustrated in FIG. 2. In such a manner, when reinforcing band 22 is fixedly attached around lip 21, triangular end 24*a* mates with the matching notched end 24*b* to minimize or prevent any overlap of reinforcing band 22 around lip 21. While the figures illustrating the mating of triangular end 24*a* and notched end 24*b* show a gap, in some embodiments, triangular end 24*a* and notched end 24*b* connect with substantially no gap. In some embodiments, triangular end 24*a* and notched end 24*b* connect with a small or minimal gap. Thus, if reinforcing band 22 is kept substantially uniform around lip 21, there is less opportunities for reinforcing band 22 to be prematurely detached from lip 21 as universal cover 10 is used (e.g., wipes brushing against reinforcing band 22, reinforcing band 22 brushing against other objects as universal cover 10 is inserted and removed from bags or other containers). While in other embodiments, triangular end 24*a* and notched end 24*b* overlap such that no gap exists between the ends.

In some embodiments, the lip 21 around the opening 20 in top wall 31 is not sandwiched between reinforcing band 22. For example, reinforcing band 22 can be attached only to the visible surface of top wall 31 around the lip 21 of opening 20. Alternatively, reinforcing band 22 can be attached only to the underside around the lip 21 of opening 20. In one such embodiment, that reinforcing band 22 is not be visible when attached only to the underside around the lip 21 of opening 20.

In some embodiments, lip 21 or the periphery of opening 20 in top wall 31 is not covered with a reinforcing band 22. In some such embodiments, the lip 21 of opening 20 may be coated or impregnated with a substantially hydrophobic (e.g., water resistant or waterproof coating). The substantially hydrophobic coating around lip 21 may extend approximately ½ an inch from lip 21 around opening 20 of top wall 31, similar to the covering provided by reinforcing band 22. In such an alternative embodiment, lip 21 is made resistant to moisture and body oils to minimize stretching, deformation, or disintegration, but less material is used to produce universal cover 10 because reinforcing band 22 is not incorporated into top wall 31. Moreover, in such an embodiment without reinforcing band 22, the manufacturing process is further simplified because less components are required for assembly.

In some embodiments, universal cover 10 does not include a cover or cap that can block opening 20 in top wall 31. Commercial wipes dispensers may include caps or covers. The caps or covers in these commercial wipes dispensers vary in shape and size. In some embodiments, including a cover or cap on universal cover 10 could interfere with one or more commercial wipes dispensers inserted in universal cover 10. Accordingly, in some embodiments, where universal cover 10 does not include a cover or cap that blocks opening 20 in top wall 31, universal cover 10 can accept a larger variety of commercial wipes dispensers and not interfere with a user's ability to open and access wipes or hygiene cloths contained in the commercial wipes dispensers while such commercial wipes dispensers are inserted in universal cover 10.

The periphery of top wall 31 is folded under top wall 31. For example, approximately ¼ of an inch of top wall 31 material can be folded down around the periphery of top wall 31. However, it should be appreciated that any suitable amount of top wall 31 material can be folded down around the periphery of top wall 31. As illustrated in FIG. 1, flap 44*a* along edge 32 of top wall 31 is folded down and under top wall 31. Flap 44*b* along edge 30 of top wall 31 is also folded down and under top wall 31. Flap 44*c* along edge 34 of top wall is folded down and under top wall 31 (illustrated in FIG. 4). These flaps 44*a*-44*c* are used to connect to similar flaps of bottom wall 38. Having these flaps within the interior of universal cover 10 creates a rounded perimeter, which helps minimize the edges of universal cover 10 from rubbing, catching, or snagging on other objects while being inserted into other bags. The corners 52 and 54 of edge 34 are also folded down and under top wall 31.

Flap 41 (shown in phantom lines) along edge 36 of top wall 31 is also folded under top wall 31. Flap 41 may be attached to top wall 31 with adhesive. Alternatively, in some embodiments, flap 41 may be stitched to top wall 31. In alternative embodiments, flap 41 may be attached to top wall 31 with both stitching and adhesive. Flap 41 of top wall 31 is positioned at edge 36 of universal cover 10. Edge 36 is where a refill opening 39 is located. Refill opening 39 is where commercial wipes dispensers are inserted and removed from universal cover 10.

Flap 41 of top wall 31 also includes sealing devices 42*a* and 42*b* shown in phantom lines. In one embodiment, sealing devices 42*a* and 42*b* may comprise a plurality of hooks (that mate with a plurality of loops attached to bottom wall 38). In some embodiments, the hook and loops may be reversed between the top wall 31 and bottom wall 38. In an alternative embodiment, sealing devices 42*a* and 42*b* may alternatively comprise magnets (that mate with or attract polar opposite magnets attached to bottom wall 38). In an alternative embodiment, sealing devices 42*a* and 42*b* may alternatively comprise one side of button snap closures (that mate with button snap closures that are attached to bottom wall 38). It should be appreciated that any suitable sealing devices may be used for 42*a* and 42*b*.

It should therefore be appreciated that edge 36 of top wall 31 may be subject to extra stresses due to the opening and closing the universal cover 10 as well as insertion and removal of commercial wipes dispensers. Thus, the extra layer of flap 41 adds some reinforcements to top wall 31. In some embodiments, the extra layer of flap 41 creates a channel that may be used to hold sealing devices as discussed below.

Bottom wall 38 is similar to top wall 31. However, bottom wall 38 does not include a dispensing opening. Thus, bottom wall 38 is substantially solid and continuous between its peripheral edges. The periphery of bottom wall 38 is folded over top of bottom wall 38. For example, approximately ¼ of an inch of bottom wall 38 material can be folded over the top around the periphery of bottom wall 38. However, it should be appreciated that any suitable amount of bottom wall 38 material can be folded over the top around the periphery of bottom wall 38. As illustrated in FIG. 1, flap 46*a* along edge 32 of bottom wall 38 is folded over the top of bottom wall 38. Flap 46*b* along edge 30 of bottom wall 38 is also folded over the top of bottom wall 38. Flap 46*c* along edge 34 of top wall is folded over the top of bottom wall 38 (illustrated in FIG. 4). These flaps 46*a*-46*c* are used to connect to similar flaps (flaps 44*a*-44*c*) of top wall 31. Having these flaps within the interior of universal cover 10 creates a rounded perimeter, which helps minimize the edges of universal cover 10 from rubbing, catching, or snagging on other objects while being inserted into other bags. The corners 52 and 54 of edge 34 are also folded over the top of bottom wall 38.

Flap 40 along edge 36 of bottom wall 38 is also folded over the top of bottom wall 38. Flap 40 may comprise approximately ½ of an inch of bottom wall 38 material. However, it should be appreciated that any suitable amount of bottom wall 38 material can be folded over the top of bottom wall 38 for flap 40. Flap 40 may be attached to bottom wall 38 with adhesive. Alternatively, in some embodiments, flap 40 can be stitched to bottom wall 38. In alternative embodiments, flap 40 may be attached to bottom wall 38 with both stitching and adhesive. Flap 40 of bottom wall 38 is positioned at edge 36 of universal cover 10. Edge 36 is where a refill opening 39 is positioned. Refill opening 39 is where commercial wipes dispensers are inserted and removed from universal cover 10.

Flap 40 of bottom wall 38 also includes sealing devices 42*c* and 42*d*. In one embodiment, sealing devices 42*c* and 42*d* may comprise of loops (that mate with hooks attached to bottom wall 38). In some embodiments, the hook and loops may be reversed between the bottom wall 38 and top wall 31. In an alternative embodiment, sealing devices 42*c* and 42*d* may alternatively comprise of magnets (that mate with or attract polar opposite magnets attached to top wall 31). In an alternative embodiment, sealing devices 42*c* and 42*d* may alternatively comprise one side of button snap closures (that mate with button snap closures that are attached to top wall 31). It should be appreciated that any suitable sealing devices may be used for 42*c* and 42*d*.

It should therefore be appreciated that edge 36 of bottom wall 38 may be subject to extra stresses due to the opening and closing the universal cover 10 as well as insertion and removal of commercial wipes dispensers. Thus, the extra layer of flap 40 adds reinforcement to the edge 36 of bottom wall 38.

Figure 4:
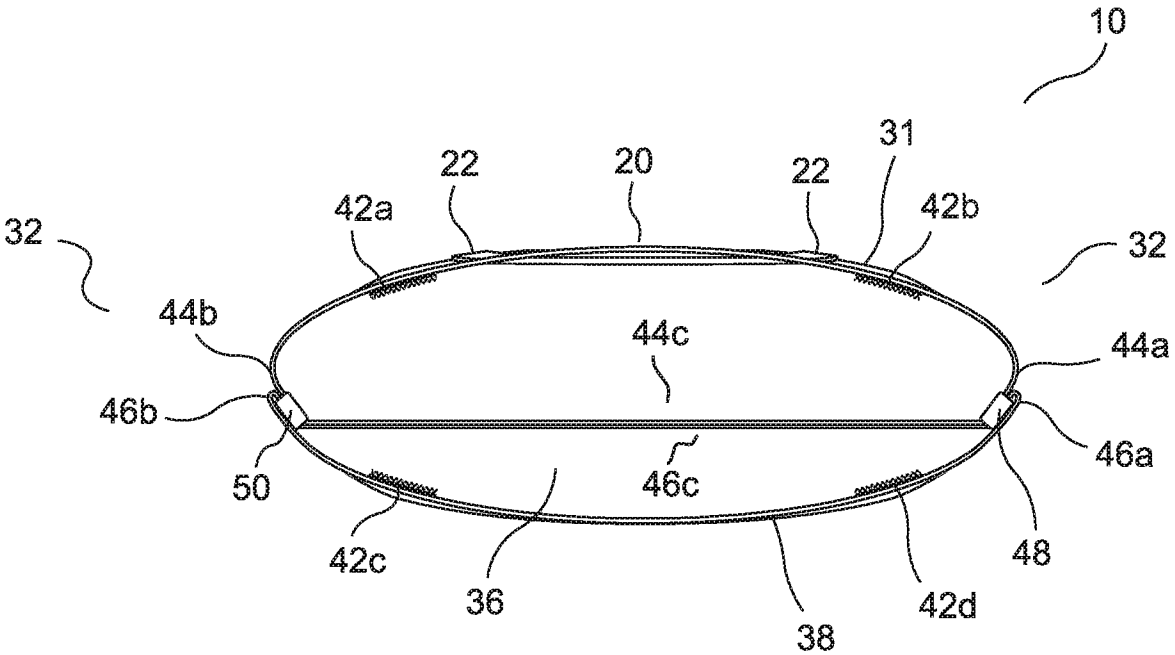
FIG. 4 is a side view facing a refill opening of one embodiment of a universal cover with a seam along the refill opening in an open position.

As should be appreciated from the description above, universal cover 10 is formed from top wall 31 and bottom wall 38, which together form flexible pouch 14. Flaps 44*a*-44*c* of top wall 31 are attached to flaps 46*a*-46*c* of bottom wall 38. Specifically, flap 44*a* of top wall 31 is attached to flap 46*a* of bottom wall 38 within pouch 14 of universal cover 10 to form a first seam. Flap 44*b* of top wall 31 is attached to flap 46*b* of bottom wall within pouch 14 of universal cover 10 to form a second seam. Likewise, flap 44*c* of top wall 31 is attached to flap 46*c* of bottom wall 38 within pouch 14 of universal cover 10 to form a third seam (as illustrated in FIG. 4). The flaps of top wall 31 and bottom wall 38 may be attached with stitching in one embodiment. In some such embodiments, the stitching includes one row of stitching. In some such embodiments, the stitching includes at least two rows of stitching. In some embodiments, two rows of stitching is used for only a portion of the first seam and second seam near the opening around edge 36. However, other types of stitching can be used. In an alternative embodiment, the flaps of top wall 31 and bottom wall 38 may be attached with adhesive. In some embodiments, both stitching and adhesive may be used to attached the flaps of top wall 31 and bottom wall 38. Any suitable attachment mechanism may also be used to attached the flaps of top wall 31 and bottom wall 38 to create the respective seams.

In some embodiments, the combination of flap 44*a* and 46*a* (the first seam) are attached to either the top wall 31 or the bottom wall 38; the combination of flap 44*b* and 46*b* (the second seam) are attached to either the top wall 31 or the bottom wall 38; and the combination of flap 44*c* and 46*c* (the third seam) are attached to either the top wall 31 or the bottom wall 38. That is, the seams are attached to either the top wall 31 or bottom wall 38 to lie substantially flat, which minimizes the protrusion of these seams in the area of pouch 14. These seams can be attached to top wall 31 and bottom wall 38 with adhesive, stitching, or a suitable combination of the foregoing. Any suitable attachment mechanism may be used to attach the seams to top wall 31 or bottom wall 38. In some embodiments, the first seam is attached to the top wall 31 and the second seam is attached to the bottom wall 38. This alternating seam structure enables inserted commercial wipes dispensers to be better centered within pouch 14 over seams being attached to the same top wall 31 or bottom wall 38. This alternating seam structure also enables commercial wipes dispensers to be inserted at an angle such that external seams from the commercial wipes dispensers can avoid brushing or catching the first seam and second seam. In one embodiment, the third seam may not be attached to either wall and may naturally protrude into pouch 14. It should be appreciated that inserting commercial wipes dispensers into pouch 14 will be easier when the seams are attached to either top wall 31 or bottom wall 38. Fewer seam protrusions in pouch 14 results in less interference when sliding a commercial wipes dispenser into the area of pouch 14 of universal cover 10.

FIG. 1 also illustrates that the first seam is covered on both sides with a seam cover 48. Likewise, the second seam is covered on both sides with a second seam cover 50. These seam covers may extend approximately ½ an inch to 1 inch along the y dimension as is further illustrated in FIG. 6. However, any suitable length of seam cover may be used. In some embodiments, the seam covers 48 and 50 can extend along the entire length of edge 30 and 32. These seam covers 48 and 50 serve to further protect the seams from wear as these seams are exposed to stresses related to opening edge 36 of universal cover 10 as well as rubbing from the insertion and removal of commercial wipes dispensers. It should be appreciated that in alternative embodiments, the seam covers are not used. In still other embodiments where the seams are attached to either top wall 31 or bottom wall 38, the seam covers may cover the exposed side of the seam (e.g., the side of the seam that is not attached to one of top wall 31 or bottom wall 38.

It should be understood that a fourth seam is created along edge 36 of universal cover 10 when top wall 31 and bottom wall 38 are brought together. After a commercial wipes dispenser is inserted into pouch 14, the pouch 14 can be sealed when top wall 31 and bottom wall 38 are brought together along edge 36. The sealing device 42*a* adheres to sealing device 42*c* and sealing device 42*c* adheres to sealing device 42*b* to create the fourth seam along edge 36. When sealing device 42*a* adheres to sealing device 42*c* and sealing device 42*b* adheres to sealing device 42*d*, universal cover 10 creates the pouch 14 that can retain a commercial wipes dispenser. It should also be appreciated that sealing device 42*a* is detachable from sealing device 42*c* and sealing device 42*b* is detachable from sealing device 42*d*. These sealing devices 42*a*-42*d* can be repeatably attached and detached any number of times. In alternative embodiments, fewer or more sealing devices may be used to create a weaker or stronger seam. Using such sealing devices for the fourth seam enables the fourth seam to be operated (opened and closed) with one hand. Moreover, when the outer surface of top wall 31, the outer surface of bottom wall 38, or both include surfaces with sufficient friction, a user may operate the fourth seam with one hand and also insert a commercial wipes dispenser into pouch 14 of universal cover 10 with one hand.

FIG. 2 is a top view of one embodiment of the universal cover 10. FIG. 2 further illustrates an unattached, exploded view of reinforcing band 22.

Figure 3:
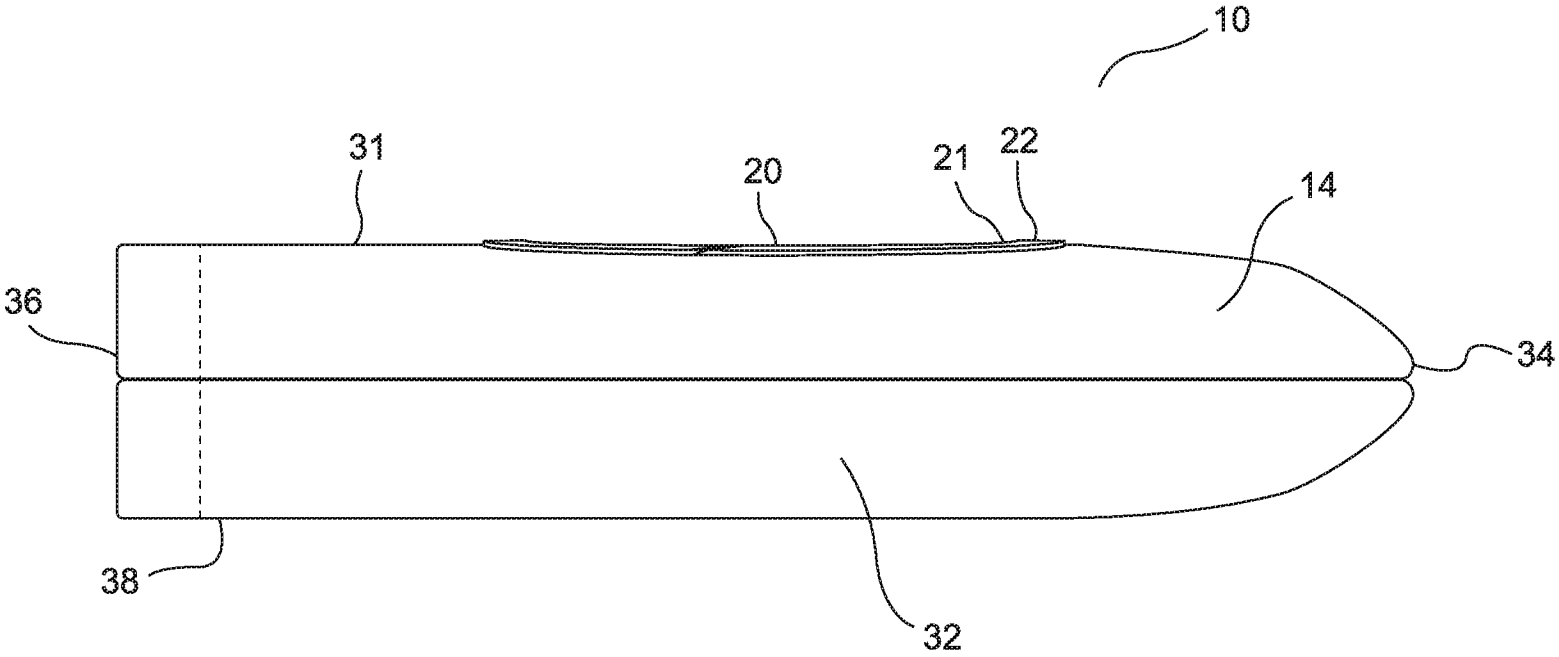
FIG. 3 is a side view of one embodiment of a universal cover with a seam in an open position.

FIG. 3 is a side view of one embodiment of the universal cover 10 when viewed from edge 32. Edge 36 of universal cover 10 is in the open position. Bottom wall 38 is visible and shows no opening, unlike top wall 31. Top wall 31 shows opening 20 with lip 21 covered by reinforcing band 22.

FIG. 4 is a side view of one embodiment of universal cover 10 when viewed from edge 36. Edge 36 is in an open position, where sealing device 42*a* is detached from sealing device 42*d* and sealing device 42*b* is detached from sealing device 42*c*. While edge 36 of universal cover 10 is in an open position, a commercial wipes dispenser can be inserted into the three sided cavity created by the seams formed from flaps 44*a* and 46*a*; flaps 44*b* and 46*b*, and flaps 44*c* and 46*c*. The seams formed from flaps 44*a* and 46*a*; flaps 44*b* and 46*b* are more clearly illustrated as attached to bottom wall 38 so that the seams protrude less in pouch 14. The seam created by connecting flaps 44*c* and 46*c* is visible in FIG. 4. A front view of seam covers 48 and 50 is visible, which illustrates seam covers 48 and 50 covering the tops and bottoms of their respective seams. Also visible are sealing devices 42*a* and 42*b*. It should be appreciated that in some embodiments, sealing devices 42*a*, 42*b*, 42*c*, and 42*d* may be covered by flaps 40 and 41. For example, if sealing devices 42*a*, 42*b*, 42*c*, and 42*d* are magnets, these sealing devices may be concealed under flaps 40 and 41 to reduce protrusions that could impede the insertion and removal of a commercial wipes dispenser from the refill opening 39 created by pouch 14. FIG. 4 also illustrates one embodiment where reinforcing band 22 wraps around lip 21 of top wall 31. That is, lip 21 of top wall 31 is sandwiched or otherwise positioned between two layers of reinforcing band 22. It should be appreciated that in some embodiments, other seams of universal cover 10 can be constructed as a resealable seam like the fourth seam. For example, the seam created by connecting flaps 44*c* and 46*c* can be a resealable seam in some embodiments, creating two resealable seams in universal cover 10. In some embodiments, when both of such seams are in an open position, a user can insert a commercial wipes dispenser in one open seam while the second open seam allows an existing commercial wipes dispenser in the universal cover 10 to be ejected from the universal cover 10.

Figure 5:
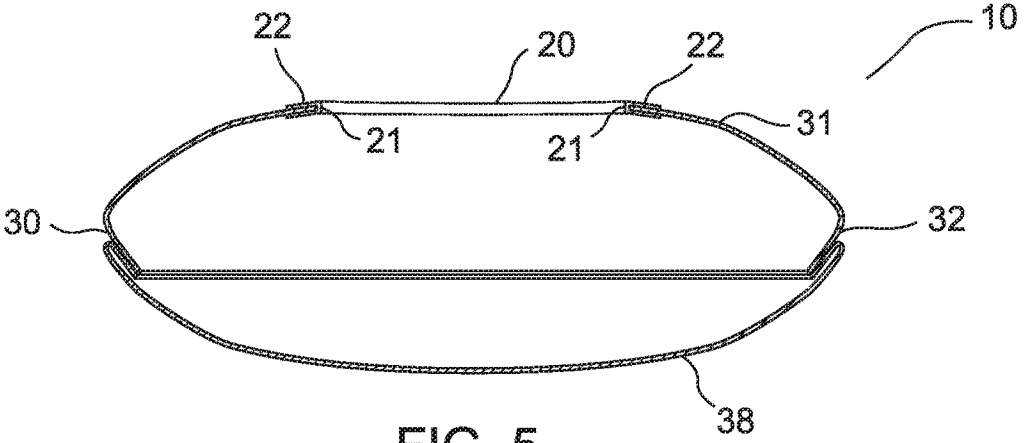
FIG. 5 is a cross-section view of the universal cover taken along line 5.
Figure 6:
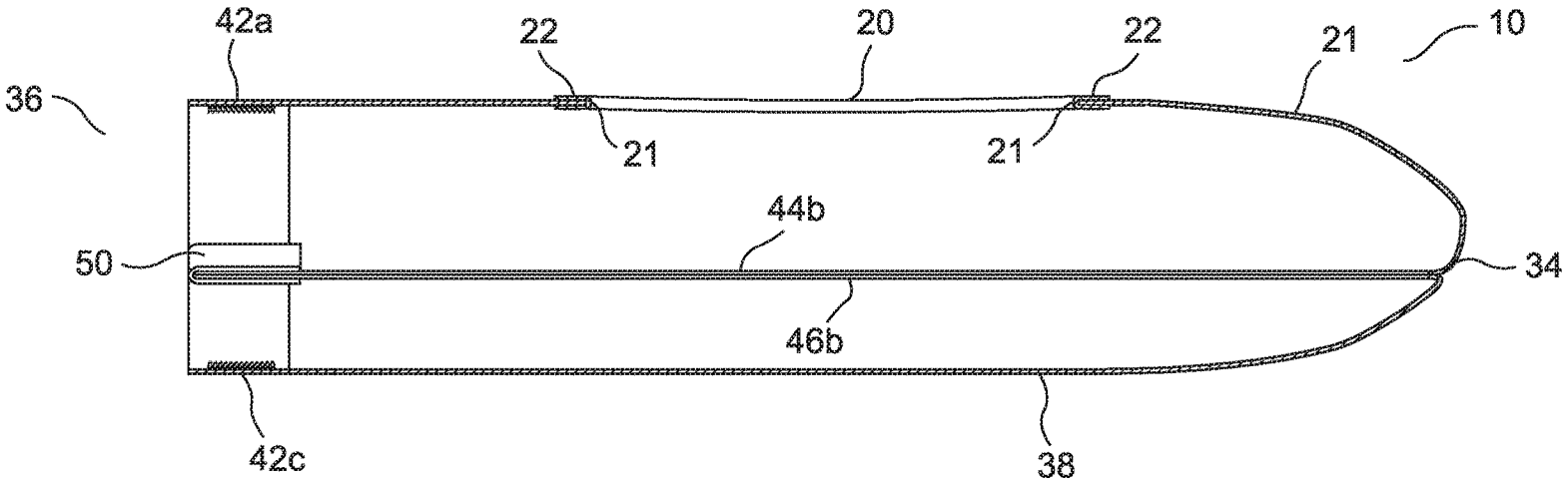
FIG. 6 is a cross-section view of the universal cover taken along line 6.

FIG. 5 is a cross-section view of the universal cover 10 taken along line 5 as illustrated FIG. 2. FIG. 6 is a cross-section view of the universal cover 10 taken along line 6 as illustrated FIG. 2. The seam formed from flaps 44*b* and 46*b* is illustrated extending substantially along the y dimension.

Figure 7:
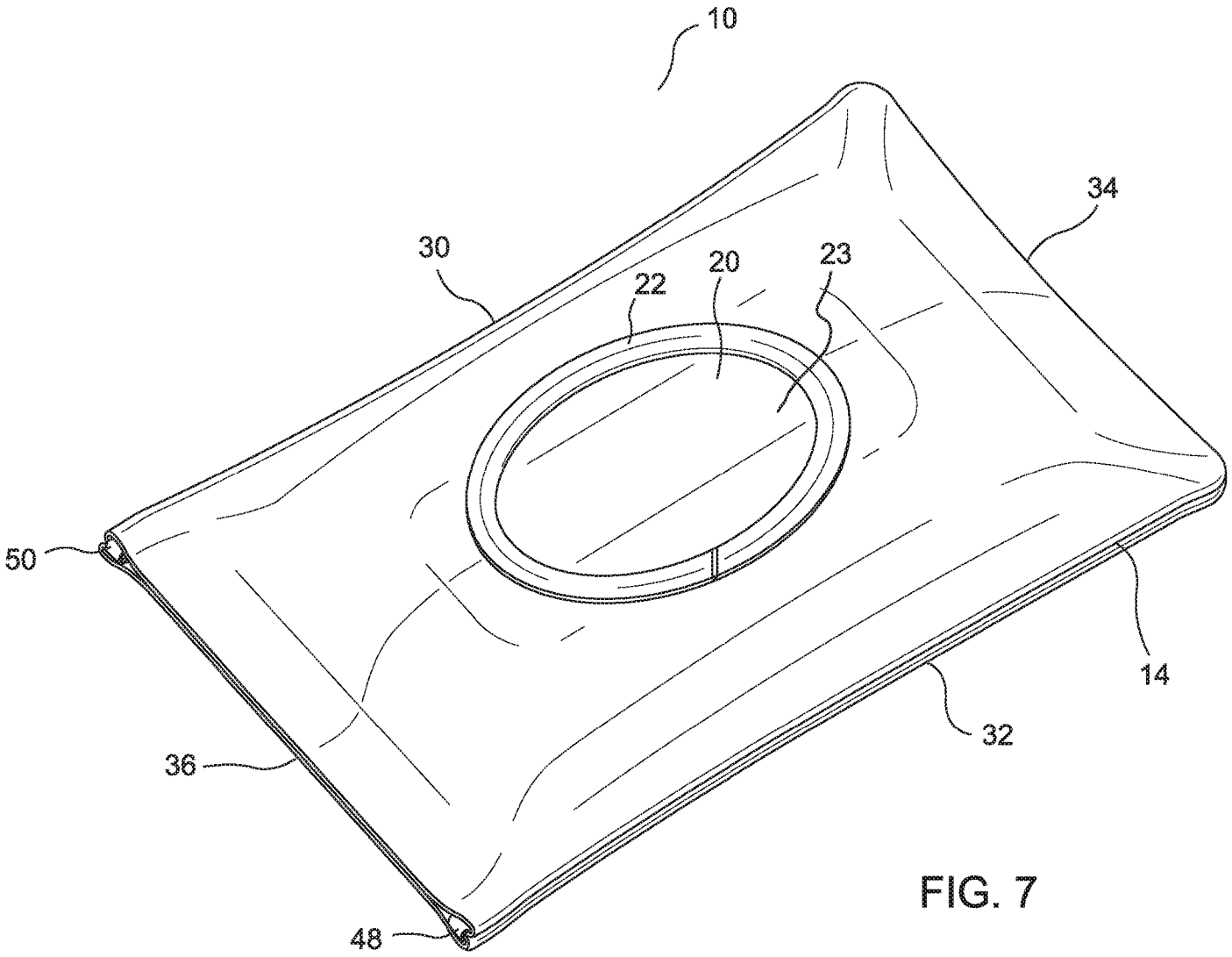
FIG. 7 is a front perspective view of one embodiment of a universal cover with the refill opening in a closed position holding an example closed commercial hygiene cloth dispenser.

FIG. 7 is a front perspective view of one embodiment of the universal cover 10 with the refill opening 39 along edge 36 in a closed position. The universal cover 10 is shown with a commercial wipes dispenser 23 contained in pouch 14. The commercial wipes dispenser 23 includes a movable cover that is in a closed position. The opening 20 in universal cover 10 enables full and unobstructed access to the movable cover of the commercial wipes dispenser 23.

Figure 8:
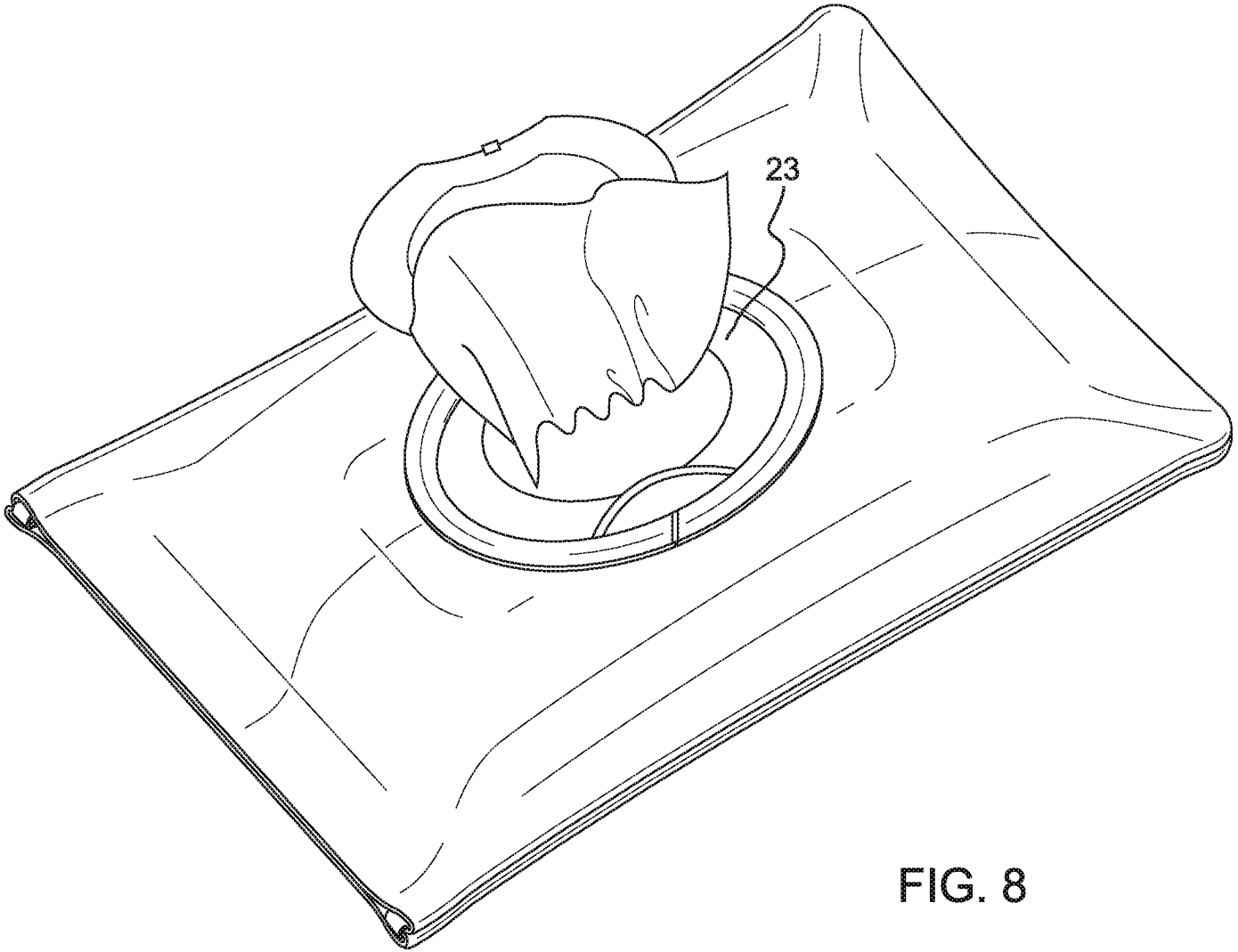
FIG. 8 is a front perspective view of one embodiment of a universal cover with the refill opening in a closed position holding an example open commercial hygiene cloth dispenser dispensing a hygiene cloth.

FIG. 8 is a front perspective view of one embodiment of the universal cover 10 with the refill opening 39 along edge 36 in a closed position. The universal cover 10 is shown with a commercial wipes dispenser 23 contained in pouch 14. The commercial wipes dispenser 23 includes a movable cover that is in an open position. The opening 20 in universal cover 10 enables full and unobstructed access to the wipes contained in the commercial wipes dispenser 23. A wipe protrudes from the commercial wipes dispenser 23 through universal cover 10.

In some embodiments, top wall 31 and bottom wall 38 are formed from flexible materials that include, but are not limited to, leather and synthetic leather. In some embodiments, top wall 31 and bottom wall 38 are made from the same material. In some embodiments, top wall 31 and bottom wall 38 are made from different materials. In embodiments where top wall 31 and bottom wall 38 are made from different materials, one of the materials can be stiffer than the other to provide added support to universal cover 10 (to maintain the shape of universal cover 10). In one embodiment, where goat leather is used for top wall 31 and bottom wall 38, the goat leather material ranges in weight between 2 oz to 3 oz and ranges in thickness between 0.8 and 1.2 mm. In an alternative embodiment where cow leather is used for top wall 31 and bottom wall 38, the cow leather material ranges in weight between 2.5 oz to 3.5 oz and ranges in thickness between 1.0 mm and 1.44 mm. The thickness of the materials (e.g., leather, synthetic leather, etc.) that can be used for aspects of universal cover 10 helps make universal cover 10 puncture and tear resistant. The puncture and tear resistance of universal cover 10 helps prevent commercial packaging of premoistened hygienic cloths from being damaged when such packaging is housed within universal cover 10, which helps prevent such premoistened hygienic cloths from prematurely drying out in the commercial packaging. If higher weights and thicknesses are used for leather or synthetic leather for the top wall 31 and bottom wall 38, the weight of the universal cover 10 becomes too heavy for comfortable carrying. The additional bulk from increased material thicknesses may hinder universal cover 10 from being placed in other bags such as diaper bags, purses, backpacks. Moreover, the higher weight and thickness of the material increases the stiffness of the leather, making it difficult for the material of top wall 31 and bottom wall 38 to flex to enable easy insertion and removal of a commercial wipes dispenser in universal cover 10.

It should be appreciated that top wall 31 and bottom wall 38 may alternatively be formed from polymers (e.g., synthetic rubber), reinforced fabrics (e.g., polymer reinforced fabrics), synthetic rubber, and other materials that maintain flexibility and weight similar to the leather specifications outlined above. In some embodiments, top wall 31 and bottom wall 38 are substantially hydrophobic (e.g., water resistant or waterproof) and substantially oleophobic (e.g., oil resistant or oil proof). In some embodiments top wall 31 is substantially hydrophobic (e.g., water resistant or waterproof) and substantially oleophobic (e.g., oil resistant or oil proof), while bottom wall 38 is not hydrophobic and not oleophobic.

In one embodiment, reinforcing band 22 is made from a material different from the material used for top wall 31 and bottom wall 38. In some embodiments, reinforcing band 22 is a thinner material than the material of top wall 31. In some embodiments, reinforcing band 22 is a stiffer material than the material of top wall 31. However, reinforcing band 22 may be made from, without limitation, leather, synthetic leather, polymers (e.g., synthetic rubber), reinforced fabrics (e.g., polymer reinforced fabrics), synthetic rubber, and other materials that maintain flexibility and weight similar to the leather specifications outlined below. In one such embodiment, the reinforcing band 22 is made from lambskin leather. The lambskin leather material ranges in weight between 1 oz to 1.5 oz and ranges in thickness between 0.4 mm and 0.6 mm. Thus, it should be appreciated that reinforcing band 22 is substantially thinner and lighter in weight than the materials of top wall 31 and bottom wall 38. In some embodiments, where the materials of top wall 31, bottom wall 38, and reinforcing band 22 have a grain direction, the grain direction of the reinforcing band 22 is positioned in a different direction than the grain direction of the materials of top wall 31 and bottom wall 38. In this manner, as stretching forces (e.g., caused by, but not limited to, wetting and drying) are applied to top wall 31 and reinforcing band 22, the different grain directions counteract each other to strengthen the lip 21 around opening 20 from substantial deformation. In some embodiments, the reinforcing band 22 is constructed to be substantially hydrophobic (e.g., water resistant or waterproof) and substantially oleophobic (e.g., oil resistant or oil proof).

Universal cover 10 provides numerous advantages over wipes dispensers that are typically provided with commercially available wipes. Commercially available wipes or hygienic cloths are typically sold in disposable containers (e.g., wipes dispensers). These disposable containers are often produced in a portable format that travel everywhere with its users. The disposable containers are often tossed, stuffed into small spaces, placed on all manner of surfaces, and are generally treated very roughly. As a result, the disposable containers often take a beating, but are ill suited for the task of protecting the wipes contained in the disposable containers. The disposable containers are typically made from very thin plastic. The thin plastic disposable containers can be easily torn or punctured. When the thin plastic disposable containers are torn or punctured, such tears or punctures (however small) will cause premoistened wipes to prematurely dry out. When premoistened wipes prematurely dry out, the wipes become unusable and render the wipes useless. Such torn or punctured disposable containers also may allow moisture from the premoistened wipes to leak out and damage other objects around the torn or punctured disposable containers. For example, when a torn disposable container is placed in a purse, the moisture from the premoistened wipes may leak into the purse. The purse may hold other objects, such as expensive electronic key fobs, phones, electronic tablets, wallets, along with the torn disposable container. Moisture from the premoistened wipes leak from the puncture or tear in the disposable container and may damage or destroy these expensive objects. In contrast to the disposable containers, various embodiments of universal cover 10 disclosed herein comprise substantially thicker materials than the thin plastic materials used for the disposable containers. These thicker materials (e.g., leather, synthetic leather, etc.) that can be used for aspects of universal cover 10 resolve the deficiencies of the thin plastic used for the commercial wipes dispensers because the thicker materials resist punctures and help prevent damage to the disposable containers housed within the universal cover 10. Preventing damage to the disposable containers storing the premoistened wipes prevents the premoistened wipes from prematurely drying out and becoming unusable. Preventing damage to the disposable containers also prevents moisture from the premoistened wipes from damaging other items that may be kept with the disposable containers. Thus, universal cover 10 enables the disposable containers to withstand the rigors of hard use and travel and keeps the wipes contained therein usable.

The disposable thin plastic wipes dispensers are also unsightly and are often manufactured in different sizes and formats, depending on the manufacturer. As another advantage, the universal cover 10 creates an attractive barrier that also keeps the thin plastic wipes dispensers from being torn or punctured. The universal cover 10 further advantageously enables a user to use any of a variety of wipes dispensers regardless of the manufacturer without interfering access to the wipes in a wipes dispenser.

A number of embodiments have been described. Various modifications may be made without departing from the spirit and scope of the invention. Accordingly, other embodiments are within the scope of the following claims.

I claim:

1. A universal cover for a hygiene cloth dispenser comprising:

a top wall periphery comprising a dispensing opening, the dispensing opening sized to accommodate a plurality of hygiene cloth dispenser openings, the top wall comprising a first material;

a bottom wall periphery;

the top wall and bottom wall defining a length dimension and a transverse width dimension, the top wall and bottom walls connected to each other along their respective peripheries to define a flexible pouch positioned between the top wall and the bottom wall;

a band around a lip of the dispensing opening comprising a second material, the second material being different from the first material of the top wall, wherein the band comprises a reinforcing strip with a pointed end and a notched end;

the universal cover comprising one or more seams that can be opened to an open position and resealed to a closed position to connect the top wall to the bottom wall, the open position configured to define a refill opening.

2. The universal cover for the hygiene cloth dispenser of claim 1, wherein the reinforcing strip wraps around the lip of the dispensing opening and the lip of the dispensing opening is positioned between a first portion of the reinforcing strip and a second portion of the reinforcing strip.

3. The universal cover for the hygiene cloth dispenser of claim 1, wherein the reinforcing strip is substantially hydrophobic and oleophobic.

4. The universal cover for the hygiene cloth dispenser of claim 1, wherein the band is a substantially hydrophobic and oleophobic material layer on the outer and inner surfaces of the top wall.

5. The universal cover for the hygiene cloth dispenser of claim 1, wherein the top wall and the bottom wall are connected to each other along their respective peripheries to form at least one seam, wherein the at least one seam is inside of the flexible pouch and is attached to the top wall.

6. The universal cover for the hygiene cloth dispenser of claim 1, wherein the top wall and the bottom wall are connected to each other along their respective peripheries to form at least one seam, wherein the at least one seam is inside of the flexible pouch and is attached to the bottom wall.

7. The universal cover for the hygiene cloth dispenser of claim 1, wherein the top wall and the bottom wall are connected to each other along their respective peripheries to form at least two seams, wherein the two seams protrude inside of the flexible pouch and one of the at least two seams is attached to the top wall and the other one of the at least two seams is attached to the bottom wall.

8. The universal cover for the hygiene cloth dispenser of claim 1, wherein the first material is a first type of leather.

9. The universal cover for the hygiene cloth dispenser of claim 8, wherein the second material is a second type of leather different from the first type of leather.

10. The universal cover for the hygiene cloth dispenser of claim 1, wherein the bottom wall comprises a third material.

11. The universal cover for the hygiene cloth dispenser of claim 10, wherein the third material is a type of leather.

12. The universal cover for the hygiene cloth dispenser of claim 1, where the one of the seams that can be opened to an open position and resealed to a closed position to connect the top wall to the bottom wall comprise a first sealing device attached to the top wall and a second sealing device attached to the bottom wall.

13. The universal cover for the hygiene cloth dispenser of claim 12, wherein the first sealing device is a plurality of hooks and the second sealing device is a plurality of loops, which removably stick together when pressed together.

14. The universal cover for the hygiene cloth dispenser of claim 12, wherein the first sealing device is a first magnet with a first polarity and the second sealing device is a second magnet with a second polarity, the first polarity and second polarity are different.

15. The universal cover for the hygiene cloth dispenser of claim 14, wherein the first sealing device is concealed behind a flap of the top wall and the second sealing device is concealed behind is a flap of the bottom wall.

* * * * *